US008479830B2

(12) United States Patent
Denoix et al.

(10) Patent No.: US 8,479,830 B2
(45) Date of Patent: Jul. 9, 2013

(54) DEPLOYMENT OF A WIRELINE TOOL

(75) Inventors: Henri Denoix, Chatenay Malabry (FR); Charles Deible, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 344 days.

(21) Appl. No.: 12/744,330

(22) PCT Filed: Nov. 20, 2008

(86) PCT No.: PCT/EP2008/009795
§ 371 (c)(1),
(2), (4) Date: Aug. 31, 2010

(87) PCT Pub. No.: WO2009/065574
PCT Pub. Date: May 28, 2009

(65) Prior Publication Data

US 2011/0000683 A1 Jan. 6, 2011

(30) Foreign Application Priority Data

Nov. 23, 2007 (GB) ..... 0722993.3

(51) Int. Cl.
*E21B 17/02* (2006.01)

(52) U.S. Cl.
USPC ..... 166/380; 166/241.5; 166/77.1

(58) Field of Classification Search
USPC ..... 166/380, 378, 241.5, 242.2, 75.14, 166/77.1, 65.1; 439/190, 191, 194, 207
See application file for complete search history.

(56) References Cited

U.S. PATENT DOCUMENTS

| | | | | | |
|---|---|---|---|---|---|
| 3,976,347 | A | * | 8/1976 | Cooke et al. | 439/132 |
| 4,039,237 | A | * | 8/1977 | Cullen et al. | 439/191 |
| 4,199,210 | A | * | 4/1980 | Trott | 439/201 |
| 4,416,495 | A | * | 11/1983 | Regan | 439/192 |
| 4,589,717 | A | * | 5/1986 | Pottier et al. | 439/277 |
| 4,700,778 | A | * | 10/1987 | Smith et al. | 166/254.2 |
| 4,898,541 | A | * | 2/1990 | Lhuillier | 439/248 |
| 4,921,438 | A | * | 5/1990 | Godfrey et al. | 439/190 |
| 4,945,987 | A | * | 8/1990 | Wittrisch | 166/250.17 |
| 5,967,816 | A | * | 10/1999 | Sampa et al. | 439/190 |
| 2003/0029978 | A1 | * | 2/2003 | Meuth et al. | 248/230.8 |
| 2004/0177681 | A1 | * | 9/2004 | Harthorn et al. | 73/152.57 |

(Continued)

FOREIGN PATENT DOCUMENTS

| | | |
|---|---|---|
| EP | 0860907 | 8/1998 |
| GB | 2263203 | 7/1993 |

*Primary Examiner* — Daniel P Stephenson
(74) *Attorney, Agent, or Firm* — Stephanie Chi; Darla Fonseca; Jody DeStefanis

(57) ABSTRACT

Apparatus and a method for deploying a wireline tool in a borehole. The apparatus comprises a wireline cable which is connected at a first end at the surface and is releasably connected at a second end to a first end of an umbilical cable via a first connection means. A second end of the umbilical cable is releasably connected to the logging head of a wireline tool via a first latching means, wherein the logging head provides for mechanical and electrical connection between the wireline tool and the wireline cable via the umbilical cable. The umbilical cable is surrounded by umbilical pipe downhole, and the logging head also provides for mechanical and hydraulic connection between the umbilical pipe and the wireline tool. The wireline tool is releasable from connection with the umbilical cable by a release means in the first latching means, and is capable of being pulled through the first latching means and through the umbilical pipe so that it is retrievable from the borehole.

18 Claims, 7 Drawing Sheets

U.S. PATENT DOCUMENTS

2007/0151735 A1* 7/2007 Ravensbergen et al. ... 166/308.1
2008/0185152 A1* 8/2008 Sbordone et al. ..... 166/341
2010/0206574 A1* 8/2010 Edwards ..... 166/355
2011/0261647 A1* 10/2011 Tabarovsky et al. ..... 367/35
2011/0277299 A1* 11/2011 Deible et al. ..... 29/428

* cited by examiner

DEPLOYMENT OF A WIRELINE TOOL

CROSS-REFERENCE TO RELATED APPLICATIONS

The present application is based on and claims priority to GB Application No. 0722993.3, filed 23 Nov. 2007; and International Patent Application No. PCT/EP2008/009795, filed 20 Nov. 2008. The entire contents of each are herein incorporated by reference.

TECHNICAL FIELD

This invention relates to an apparatus and method for deploying a wireline tool and an umbilical conduit down a borehole. More particularly, the invention relates to an apparatus and method for deploying a wireline tool and an umbilical conduit down a borehole in an oil or gas well.

BACKGROUND ART

Specialized delivery systems are available to place equipment in wellbores far from the surface and to extract information from downhole locations.

Conventionally drillpipe has conveyed drilling bits and drilling equipment, and wireline cable has been used for downhole logging measurements, perforating and setting equipment. Measurements are also now made while drilling. Wireline cables are now stronger and longer, and can be used to convey drilling bits and equipment.

As wellbores become deeper, have more complex trajectories and are located in more challenging environments, new forms of delivery systems and equipment are needed.

The advantages of the current invention over known apparatus and methods for the deployment of a wireline tool down a wellbore are that it allows for deployment of an electric hydraulic umbilical where all electrical connections are made at the surface, dry. That is, it does not require the use of surface or downhole wet connects, which can be problematic under high power loads, in certain well fluids and in small diameters. The umbilical can be as long as required for the application, and it allows for the transport of fluids over the length of the umbilical, while maintaining a wireline connection between the downhole tool and the surface. In addition, the electric hydraulic umbilical can be implemented using conventional and readily available pipes and wireline. Therefore, more demanding custom pipes and wireline can be used.

DISCLOSURE OF INVENTION

A first aspect of the invention provides apparatus for deploying a wireline tool and an umbilical conduit in a borehole, the apparatus comprising:

- a wireline cable which is connected at its one end (a first end) at the surface and is releasably connected at its other end (a second end) to one end (a first end) of an umbilical cable via a first connection means;
- the other end of the umbilical cable is releasably connected to the logging head of a wireline tool via a first latching means, the logging head providing for mechanical and electrical connection between the wireline tool and the wireline cable via the umbilical cable;
- the umbilical cable being surrounded by umbilical pipe, the logging head also providing for mechanical and hydraulic connection between the umbilical pipe and the wireline tool; and

- the wireline tool being releasable from connection with the umbilical cable by a release means in the first latching means, and then being able to be pulled through the first latching means and through the umbilical pipe and so that it is retrievable from the borehole.

Preferably the umbilical cable and the umbilical pipe form the umbilical conduit. Typically the umbilical conduit preferably provides electric and hydraulic connectivity.

In one form of the invention the first connection means may include a weakpoint. Further, the first latching means may include a weakpoint.

The umbilical cable and umbilical pipe may have a termination end.

The latching means preferably includes a removable barrier means that once installed, prevents the wireline cable termination from passing through. The barrier means may be a no go.

Further according to the invention there is provided apparatus for deploying a wireline tool down a borehole, which may also be used to remove a wireline tool from down a borehole.

A second aspect of the invention provides a method of deploying a wireline tool and an umbilical conduit in a borehole, the method comprising:

- connecting one end (a first end) of a wireline cable to one end (a first end) of an umbilical cable via a releasable connection means;
- connecting the other end (a second end) of the umbilical cable to a logging head of a wireline tool;
- deploying the wireline cable, connected umbilical cable and connected logging head down the borehole;
- detaching the wireline cable from the connection with the umbilical cable and replacing the connection with a latching means and suspending the umbilical cable from an umbilical pipe via a second latching means at its downhole end;
- re-attaching a wireline cable to the umbilical cable's latching means, while it is suspended from the umbilical pipe in the well;
- pulling the umbilical cable through the umbilical pipe latching means, through the umbilical pipe, and up to the surface by the wireline cable and thereby pulling the logging head into contact with the pipe latching means;
- attaching the logging head to the pipe latching means;
- wherein the logging head provides for mechanical and hydraulic connection between the umbilical pipe and the wireline tool, and there is an electrical connection provided between the wireline cable and the logging tool via the umbilical cable.

Preferably the umbilical cable and the umbilical pipe form the umbilical conduit. Typically the umbilical conduit preferably provides electric and hydraulic connectivity.

A third aspect of the invention provides a method of deploying a wireline tool in a borehole, the method comprising:

- connecting one end (a first end) of a wireline cable to one end (a first end) of an umbilical cable via a releasable connection means;
- connecting the other end (a second end) of the umbilical cable to a logging head of a wireline tool;
- deploying the wireline cable, attached umbilical cable and attached logging head down the borehole;
- releasing the wireline cable from connection with the umbilical cable;
- installing a first latching means to the umbilical cable;

attaching umbilical pipe with a second latching means to the latching means and deploying the umbilical pipe with the attached latching means downhole;

installing wireline cable through the umbilical pipe and attaching the installed wireline cable to the umbilical cable, which is attached to the latching means;

pulling the umbilical cable through the latching means, through the umbilical pipe, and up towards the surface of the borehole;

attaching the umbilical cable to a connector and attaching the umbilical cable connector to an umbilical pipe termination;

attaching umbilical pipe termination to the umbilical pipe; and attaching a wireline cable to a connector and attaching the wireline cable connector to the umbilical cable connector via the umbilical pipe termination Preferably the umbilical cable and the umbilical pipe form the umbilical conduit. Typically the umbilical conduit preferably provides electric and hydraulic connectivity.

The method may further include installing a barrier means in the first latching means, such that the wireline cable is prevented from passing through the latching means.

Preferably the barrier means is a no go.

The connection between the wireline cable and the umbilical cable is preferably mechanical. In another form of the invention the connection between the wireline cable and the umbilical cable is electrical and mechanical.

According to a fourth aspect of the invention there is provided a wireline tool and an umbilical conduit deployed in a borehole by the apparatus described above in which there is a continuous electrical connection between the logging tool and the surface.

Preferably the continuous electrical connection is housed in the umbilical conduit while allowing for the transport of fluids over the length of the umbilical and while maintaining a wireline connection between the downhole tool and surface.

Even further according to the invention there is provided a wireline tool and an umbilical conduit deployed in a borehole by the method according to the second aspect of the invention as described above.

Even further according to the invention there is provided a wireline tool and an umbilical conduit deployed in a borehole by the method according to the third aspect of the invention described above.

The umbilical conduit preferably provides electric and hydraulic connectivity between the wireline tool and the surface.

BRIEF DESCRIPTION OF FIGURES IN THE DRAWINGS

MODE(S) FOR CARRYING OUT THE INVENTION

Figure 1:
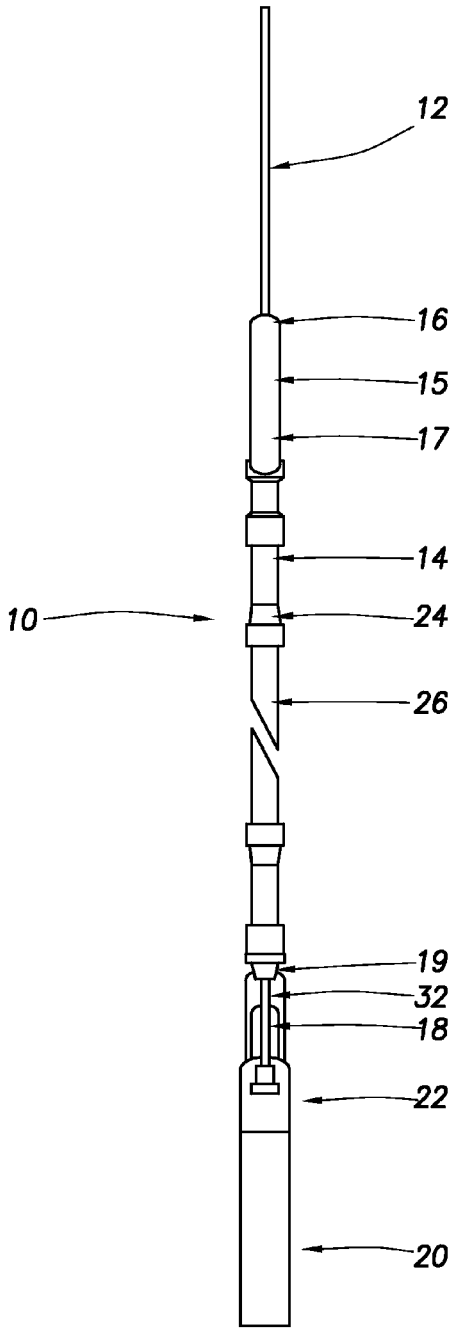
FIG. 1 shows a schematic side view of apparatus for deploying a wireline tool down a borehole, according to the invention.

A preferred embodiment of the invention is shown in FIG. 1, in which apparatus 10 for deploying a wireline tool down a borehole is shown to include a wireline cable 12, an umbilical 14, an umbilical termination 16 and a hydraulic latch sub assembly 18. Umbilical termination 16 has an upper umbilical cross-over sub 15 and a lower umbilical cross-over sub 17. Hydraulic latch assembly 18 is attached to the bottom hole assembly (BHA) 20 via cross-over to pipe connection 19, and a BHA head connection 22. Wireline cable 12 is connected to umbilical 14 by the umbilical termination 16, and umbilical 14 is connected to the BHA 20 by the hydraulic latch sub-assembly (HLS) 18.

A wireline tool (part of the BHA 20) is first deployed into a well by using standard wireline techniques for deployment into overbalanced wells. In this embodiment of the invention the umbilical cable 24 is connected to the logging head before the wireline tool is deployed. The umbilical cable 24 is then rigged-up and the logging head connected to the wireline tool. The logging head provides for mechanical and electrical connections between the tool and the umbilical cable 24 and for the mechanical and hydraulic connections between the umbilical pipe 26 and the tool. The logging head must also provide for a means to release the umbilical cable 24, so that the umbilical cable can be retrieved from the well. To do this a weakpoint is used, the weakpoint parts in such a way that it can be pulled back through the diameter of the umbilical pipe 26.

The tool is then run into the well suspended from the umbilical cable 24. Umbilical cable 24 is stopped at a predetermined depth equivalent to the desired length of the umbilical 14. At this point the umbilical cable 24 is hung off in the well using a standard T-bar 28. It is desirable to cut the cable 24 and construct the wireline termination before beginning operations to save rig time. If this is done, a spoolable cable splice 30 is required that connects the umbilical cable 24 to the wireline cable 12 mechanically and preferably electrically as well. The splice 30 must permit the cable 24 to be spooled off a drum and over sheaves under tension. If a spoolable splice is used, it is removed at this point. If not, the cable 24 must be cut and both ends properly terminated.

A special overshot, the hydraulic latch sub (HLS) 18 (also referred to herein as the overshot or the slim fishing overshot), that is designed to latch the BHA 20 is now threaded onto the umbilical cable 24 and a no-go 32 is installed. The no-go 32 ensures that the wireline cable cannot fall through the HLS 18, allowing the umbilical cable to be suspended in the well from the HLS 18. The umbilical cable 24 termination is now connected to a fishing neck 36, which is capable of being latched by a slim fishing sub 33 and pulled back to surface through the umbilical pipe 26. A burst sub can be deployed immediately above the HLS 18 if desired. The burst sub can be activated after retrieval of the umbilical cable 24 to eliminate the need to pull a wet drill string when retrieving the umbilical pipe 26.

The wireline cable 12 can now be rigged down if required for the next steps. A first joint of umbilical pipe 26 is now picked up by the rig and connected to the HLS 18. The rig then hoists the pipe 26 which interns hoists the umbilical cable 24 via the fishing neck 36 as it comes to rest on the no-go 32 previously installed in the top of the HLS 18. Once the weight is removed from the T-bar 28 it can be removed from the umbilical cable 24.

The rest of the umbilical pipe 26 is then run in the hole using standard rig techniques for running pipe. The umbilical pipe 26 can be of any variety desired. The only requirement imposed on the umbilical pipe 26 by the invention is that the slim fishing equipment (neck and overshot) must be able to pass cleanly through it.

As pipe 26 joints are connected and subsequently lowered in the well, the tool and umbilical cable 24 will descend in the well an equivalent amount as they are suspended from the bottom of the pipe 26 via the no-go 32 in the HLS 18. Care must be taken to ensure that the tool continues to fall as the pipe 26 is lowered.

Once all of the pipe 26 joints have been lowered into the well a cross over 42 from the umbilical pipe 26 to the umbilical termination can be installed on top of the pipe 26. The wireline equipment is then rigged-up, and the slim fishing overshot 18 is attached to the wireline cable 12. The wireline cable 12 is then run through the umbilical pipe 26 to latch the fishing neck 36, which is resting on top of the HLS 18 via the no-go 32. Once latched, the neck and umbilical cable 24 are pulled back to surface and out of the pipe 26.

As the latch is pulled above the rotary, and if the umbilical cable 24 and umbilical pipe 26 have been measured properly, the tool will contact the HLS 18 at a known height above the rotary. This contact must be done with sufficient speed and force to ensure that the tool properly latches to the HLS 18. The latch can be confirmed by slacking off the wireline cable 12. If the tool is properly latched there will be a significant decrease in the tension of the wireline cable 12.

It is possible at this point to apply pressure from surface inside the umbilical pipe 26 to confirm the latch. This requires that additional equipment be rigged-up on top of the umbilical pipe 26 to facilitate pumping down the pipe 26 past the umbilical cable 24 installed. Rotating the pipe 26 can also be used to confirm the latch of the tool into the HLS 18.

Once the latch has been confirmed the pump-in equipment can be removed, if it was used, and the T-bar 28 installed. It may be necessary at this point to insert pup joints to ensure proper space out of the umbilical cable 24 and umbilical pipe 26.

With the umbilical pipe 26 in the rig slips and the umbilical cable 24 safely held by the T-bar 28, the slim fishing equipment can be removed from the umbilical cable 24 and wireline cable 12, and the electro-mechanical connection installed. This connection provides for a continuous electrical pathway between the cables 24 and 12, a means to fix the wireline cable 12 to the umbilical pipe 26 and a weakpoint between the newly formed umbilical 14 and the wireline cable 12. In this manner, should it become necessary, it is possible to break the weakpoint and retrieve the wireline cable 12, leaving the complete umbilical 14 in the well ready to be fished.

The electro-mechanical connection can now be lifted allowing the removal of the T-bar 28. The last step is to mechanically connect the electro-mechanical connection to the umbilical pipe 26. The umbilical termination must be able to accommodate a variable amount of cable slack and some cable slack must be put into the umbilical pipe 26. Leaving the umbilical cable 24 taught in the umbilical pipe 26 may result in a broken cable as the pipe bends around dog-legs or expands due to temperature.

The wireline cable 12 is connected electrically to the umbilical cable 24, which is connected to the tool, allowing power and telemetry to travel between down-hole and up-hole. The wireline cable 12 is also connected mechanically to the umbilical 14 through a weakpoint. This allows the wireline cable 12 to be retrieved from the well should a fishing operation be required.

The downhole tool 20 is connected mechanically and hydraulically to the umbilical pipe 26, allowing fluid to be transported from downhole to the umbilical termination, which must provide for the fluid exit point.

The assembly can now be lifted out of the slips using the wireline cable 12 and run in the well.

To retrieve the wireline tool, the umbilical termination is brought back to surface using the wireline winch and the umbilical pipe 26 is hung off in the rig slips. The mechanical connection between the wireline cable 12 and the umbilical 14 is disconnected, and a cable clamp installed on the umbilical cable 24. The electro-mechanical connection between the wireline cable 12 and umbilical cable 24 is then removed.

The umbilical cable 24 can now be retrieved from inside the umbilical pipe 26 in a variety of ways. The preferred method is to simply hold the umbilical pipe 26 securely with the rig pipe rams and to pull on the umbilical cable 24 to part a spider type weakpoint in the logging tool head. A spider weakpoint is preferred as there is no hardware to retrieve after the weakpoint has parted. This means that the parted weakpoint can pull through nearly any restriction that the umbilical cable 24 can fit through. This is not normally the case with conventional wireline weakpoint.

Once the umbilical cable 24 has been retrieved from the well a ball can be dropped into the umbilical pipe 26 to form a seal or restriction below the burst sub (if there is one installed). This will allow the application of pressure from the surface to burst the disk of the burst sub, allowing the pipe to drain as it is pulled from the well.

Once the umbilical pipe 26 is retrieved from the well the tool can be rigged down as per standard rig techniques.

Figure 2:
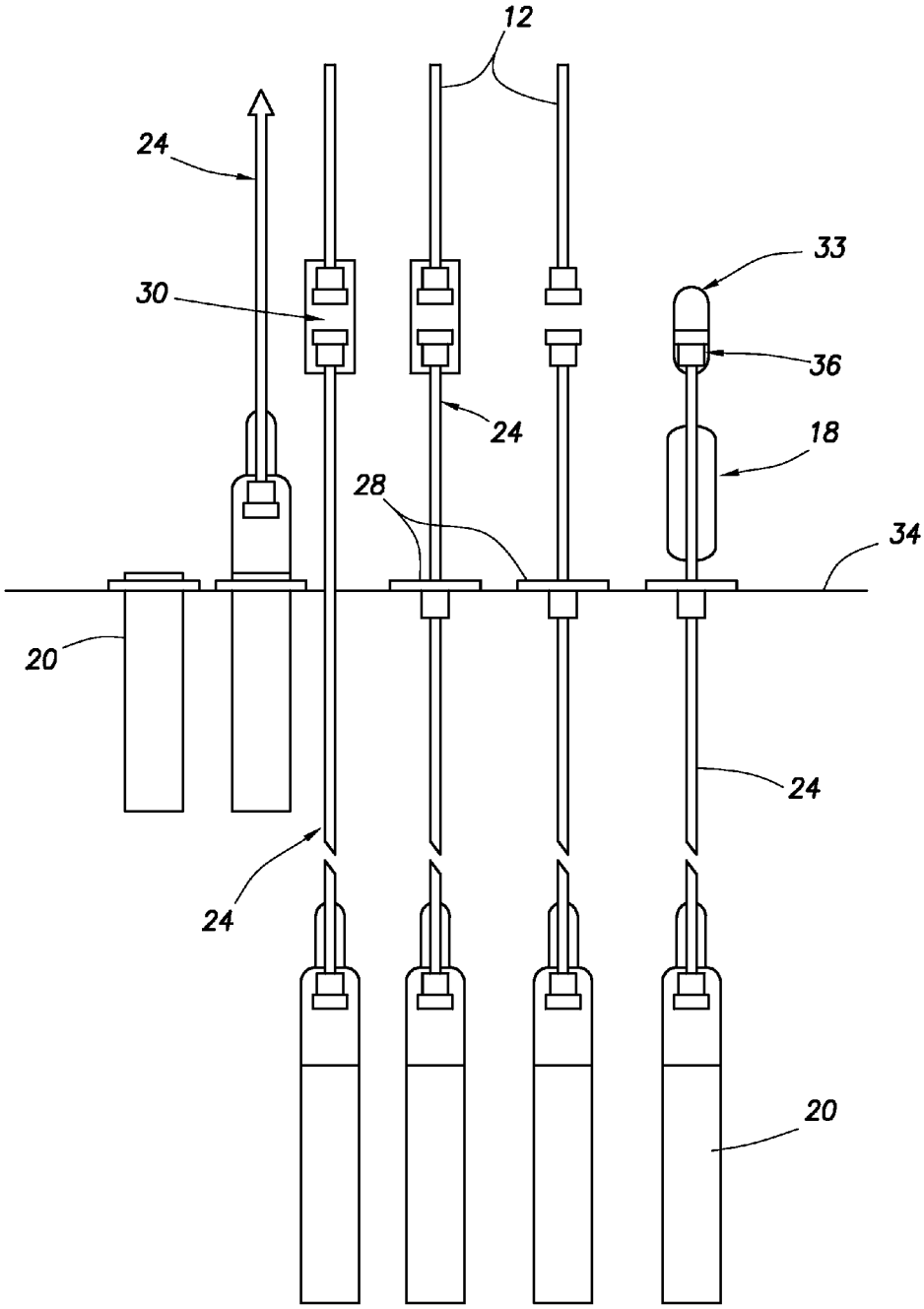
FIG. 2 shows a schematic side view of the apparatus in the first stage of progressive deployment of a wireline tool down a borehole, according to the invention.

The method of deploying a wireline tool down a borehole, according to an embodiment of the invention is further illustrated in FIGS. 2 to 7. As an example, the method includes the following steps:

Referring to FIG. 2:

1. Strap and drift all umbilical pipe joints.
1.1. Maximum umbilical length (End of well−BHA 20 length)/2.
2. Cut umbilical cable 24, 30 feet longer than length of pipe to be deployed.
3. Construct spider type rope socket of the appropriate strength on the sonde end of the umbilical cable 24.
4. Construct wireline termination on splice end of umbilical cable 24 using all armor wires.
5. Construct wireline termination on sonde end of wireline cable 12 using all armor wires.
6. Connect umbilical and wireline cables 24, 12 electrically and mechanically using a spoolable splice connection.
7. Spool umbilical cable 24 onto the wireline unit.
7.1 Alternatively the umbilical cable 24 can be spooled into the well up to desired umbilical length, hung off in the T-bar 28, cut and the terminations installed.
8. Rig up (RU) wireline.
9. Rig up downhole tool.
10. Run in hole (RIH) to the maximum deployment depth, that is twice the umbilical 14 length+100 ft to ensure the tool can descend in the well the required distance. Pull out of hole (POOH) with BHA 20 and umbilical cable 24 until spoolable connection is above the rig floor 34.

11. Leave 5 feet of cable slack above rig floor 34, and install T-bar 28 and hang off umbilical cable 24.
12. Remove SWSC splice 30.
13. Install down-hole end of slim fishing sub 36.
14. Lay down top wireline sheave.
15. Install elevators for umbilical pipe 26.
16. Strip hydraulic latch 18 over umbilical cable 24.
17. Install slim fishing spear 36 on top of umbilical cable 24.

Figure 3:
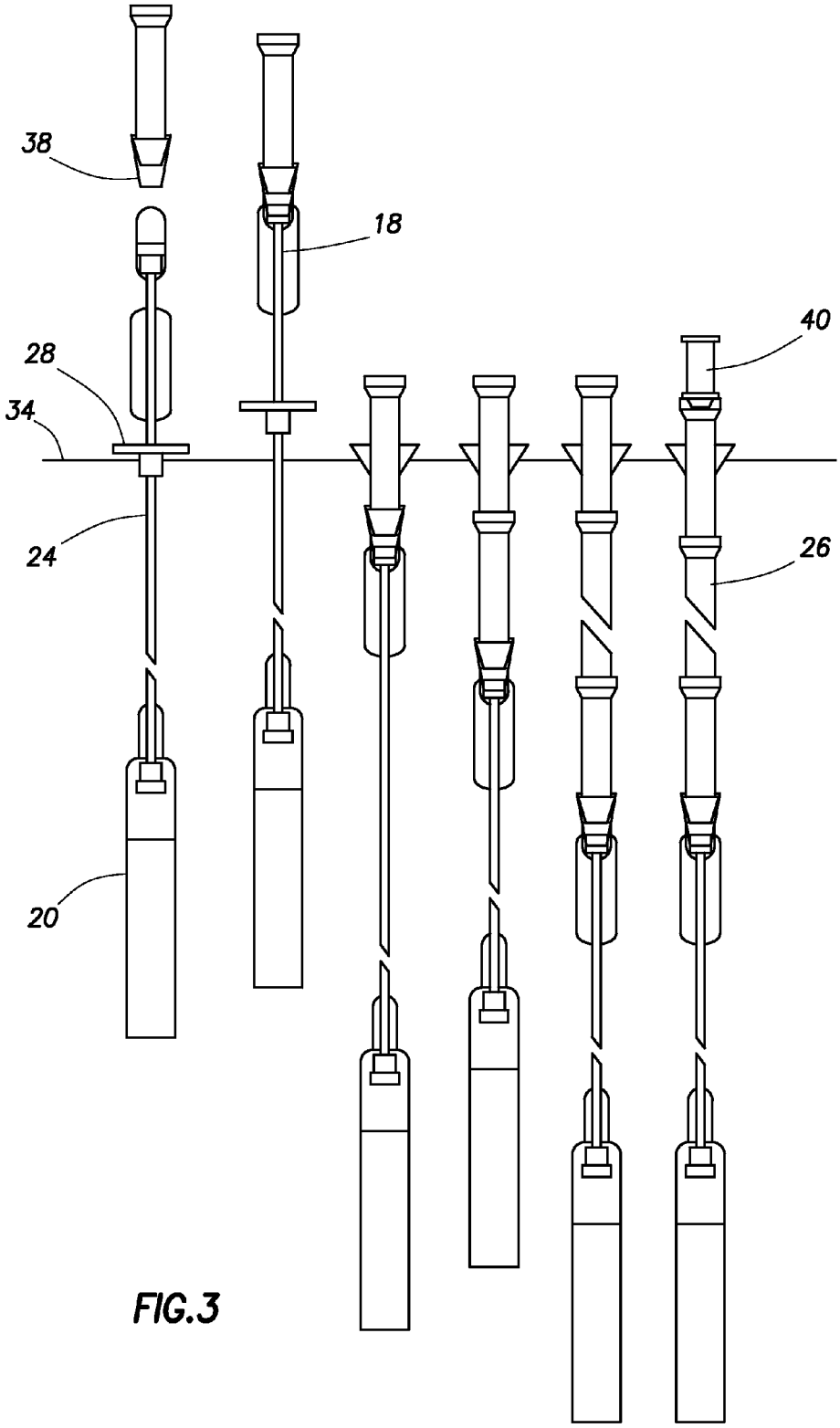
FIG. 3 shows a schematic side view of the apparatus in the second stage of progressive deployment of a wireline tool down a borehole, according to the invention.

Referring to FIG. 3:

18. Install the no-go 32 split halves in the top of hydraulic latch sub 18.
19. Pick up (PU) first pipe joint. Wireline hydraulic latch sub (HLS) 18 to CS hydrill cross-over 38 installed on cat walk.
20. Make up (MU) burst sub.
21. Make up (MU) pipe joint and hydraulic latch 18.
22. Pick up (PU) pipe joint and wireline with elevators until T-bar 28 can be removed.
23. Remove T-bar 28.
24. Run in hole (RIH) with first pipe joint—watch for BHA 20 to set down—set in slips.
25. Run in hole (RIH) with umbilical pipe 26
26. Land last pipe joint in slips.
27. In parallel with run in hole (RIH) of pipe, install fishing sub on wireline cable. Install pump-in and pack-off 40.
28. Rig up (RU) wireline top sheave.

Figure 4:
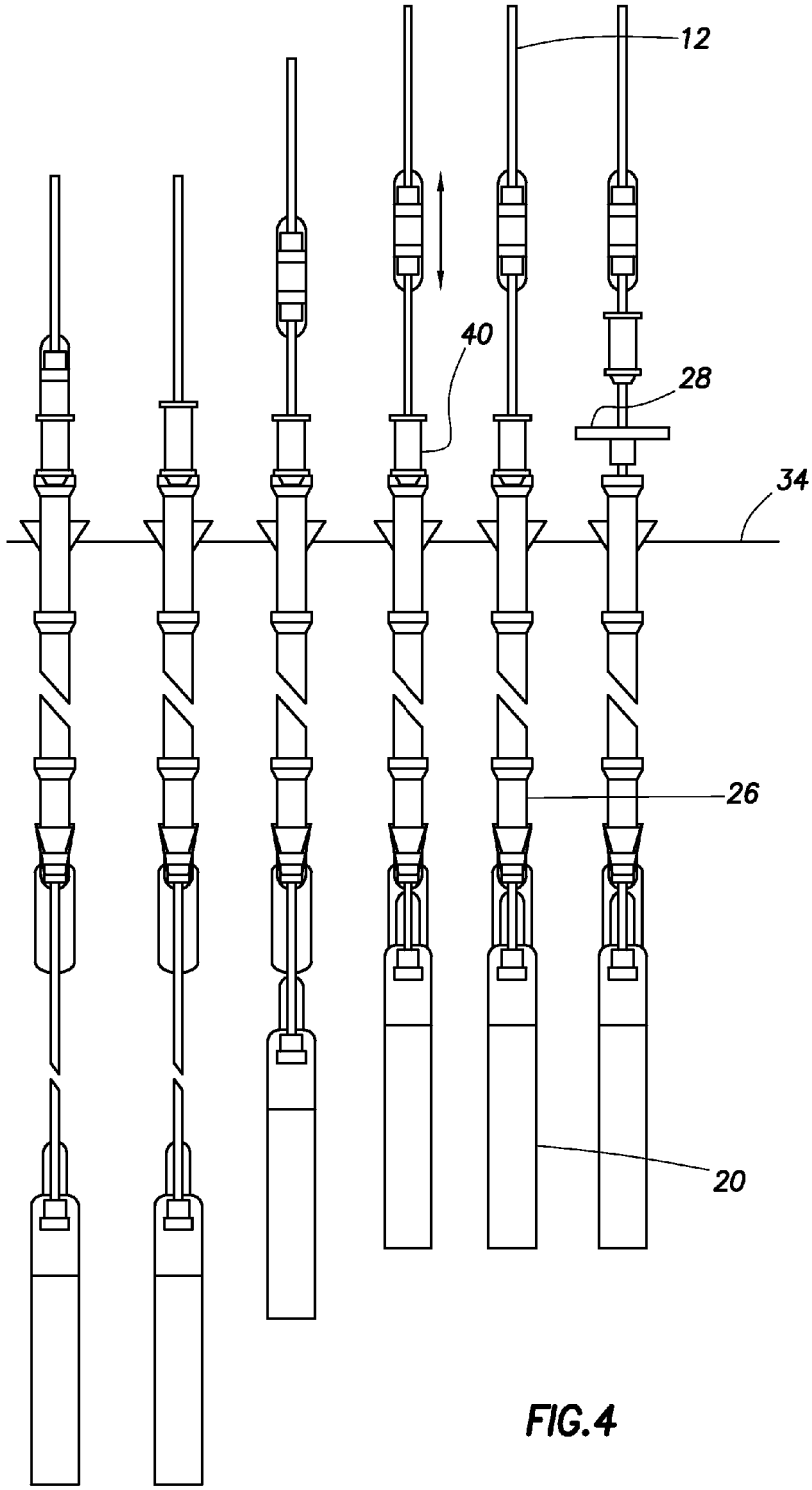
FIG. 4 shows a schematic side view of the apparatus in the third stage of progressive deployment of a wireline tool down a borehole, according to the invention.

Referring to FIG. 4:

29. Run in hole (RIH) with slim fishing overshot and weight, latch fishing overshot to spear 34.
30. Pick up (PU) and set down to confirm latch.
31. Pull out of hole (POOH) with latched overshot.
32. Pick up (PU) above rotary until BHA 20 tags bottom of pipe.
33. Pull required over tension to latch BHA 20 to bottom of umbilical pipe 26.
34. Release weight on wireline.
35. Test latch by slacking off wireline and confirm latch-rotate pipe, use pump pressure and move pipe up and down.
36. Pull normal weight measure space out (top of pipe to umbilical cable 24 rope socket). Remove pump-in and pack-off 40, if installed.
37. Pull normal weight on umbilical cable 24 and install T-bar 28.

Figure 5:
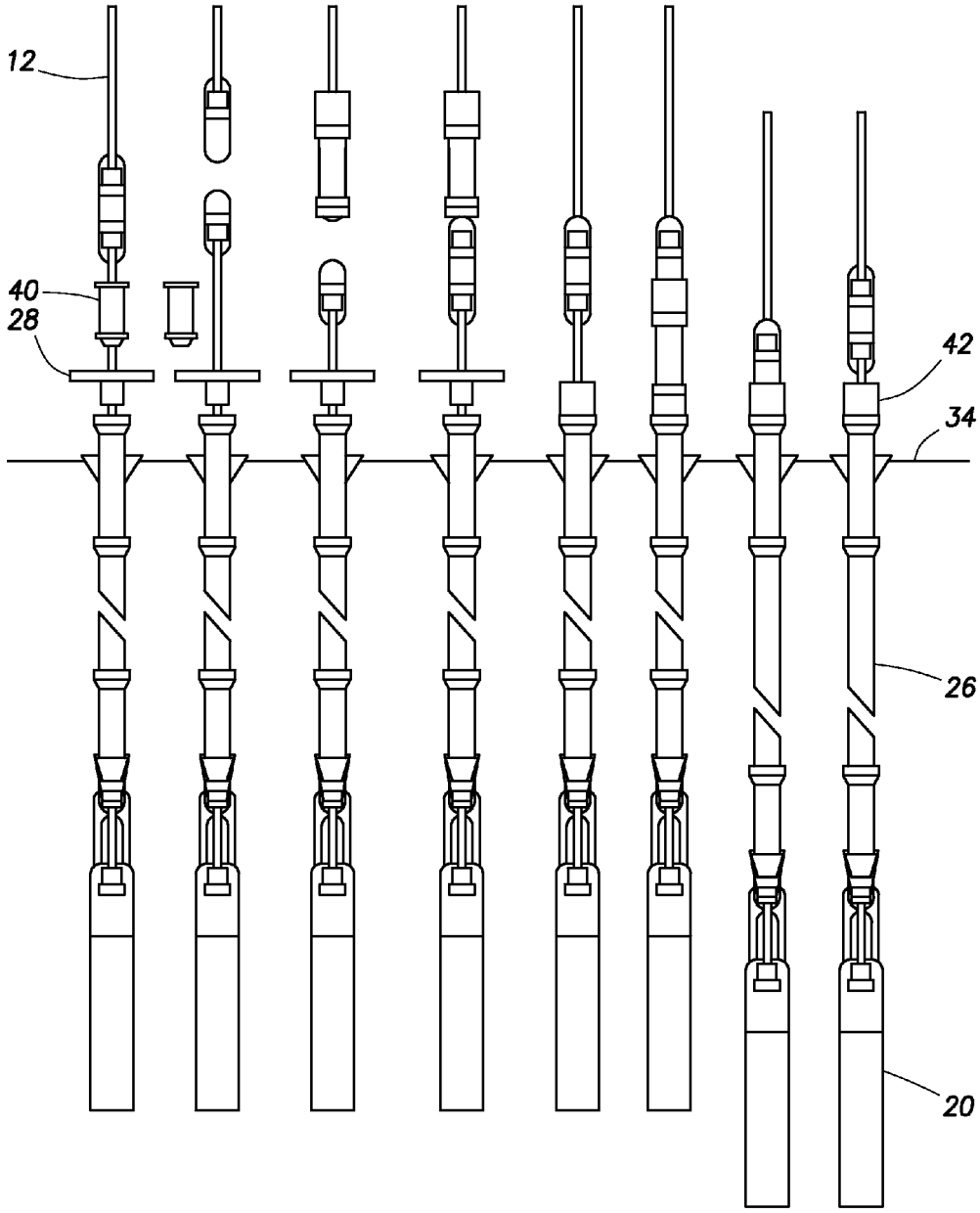
FIG. 5 shows a schematic side view of the apparatus in the fourth stage of progressive deployment of a wireline tool down a borehole, according to the invention.

Referring to FIG. 5:

38. Release slim fishing sub latch.
39. Make up (MU) pup joint(s) below non-rotating umbilical termination sub cross-over sub 42 to properly space out umbilical termination.
40. Measure space out and select the appropriate length pup joints.
41. Pick up (PU) and strip wireline cable 12 through pup joint, umbilical termination sub cross-over 42 and umbilical termination sub 15, 17.
42. Reconnect wireline spear, pull cable to 1500 lbs.
43. Remove T-bar 28.
44. Connect pup joint(s) to pipe in hole.
45. Pick up (PU) using rig hoist, lower and set in slips.
46. Lower Umbilical cable 24 into umbilical pipe 26. No more than 2 ft of cable 24 can remain above pipe 26 after installation of the pup joints when cable 24 is slaked off.
47. 1.5 ft of slack must fit back into umbilical pipe 26 to account for thermal expansion and contraction and hole geometry changes.

Figure 6:
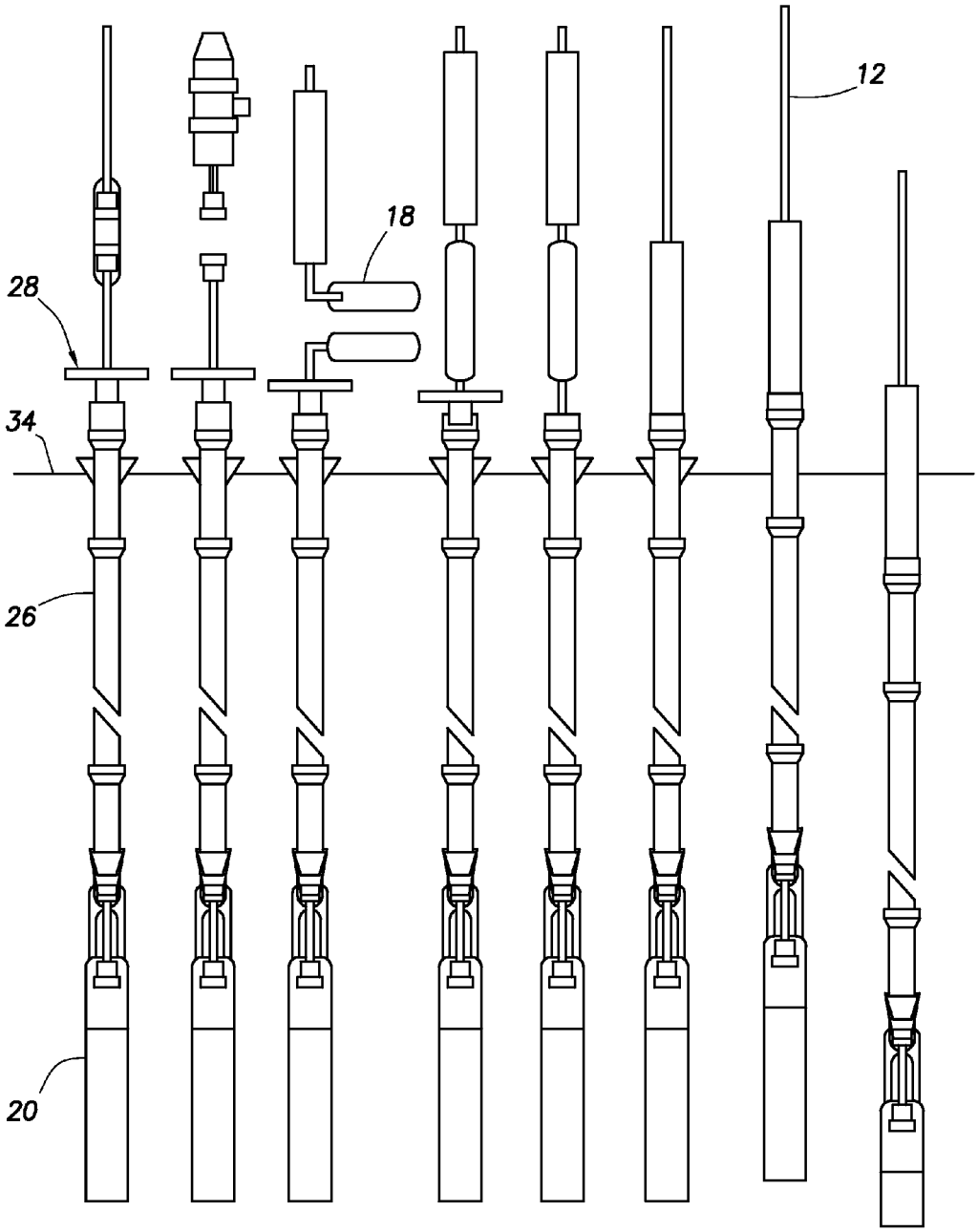
FIG. 6 shows a schematic side view of the apparatus in the fifth stage of progressive deployment of a wireline tool down a borehole, according to the invention.

Referring to FIG. 6:

48. Install T-bar 28 and remove the slim fishing assemblies from the umbilical and wireline cables 24, 12.
49. Make up (MU) wireline connection between wireline cable 12 and umbilical cable 24.
50. Pick up (PU) umbilical 14 with wireline and remove slips.
51. Run in hole (RIH) with wireline.

Figure 7:
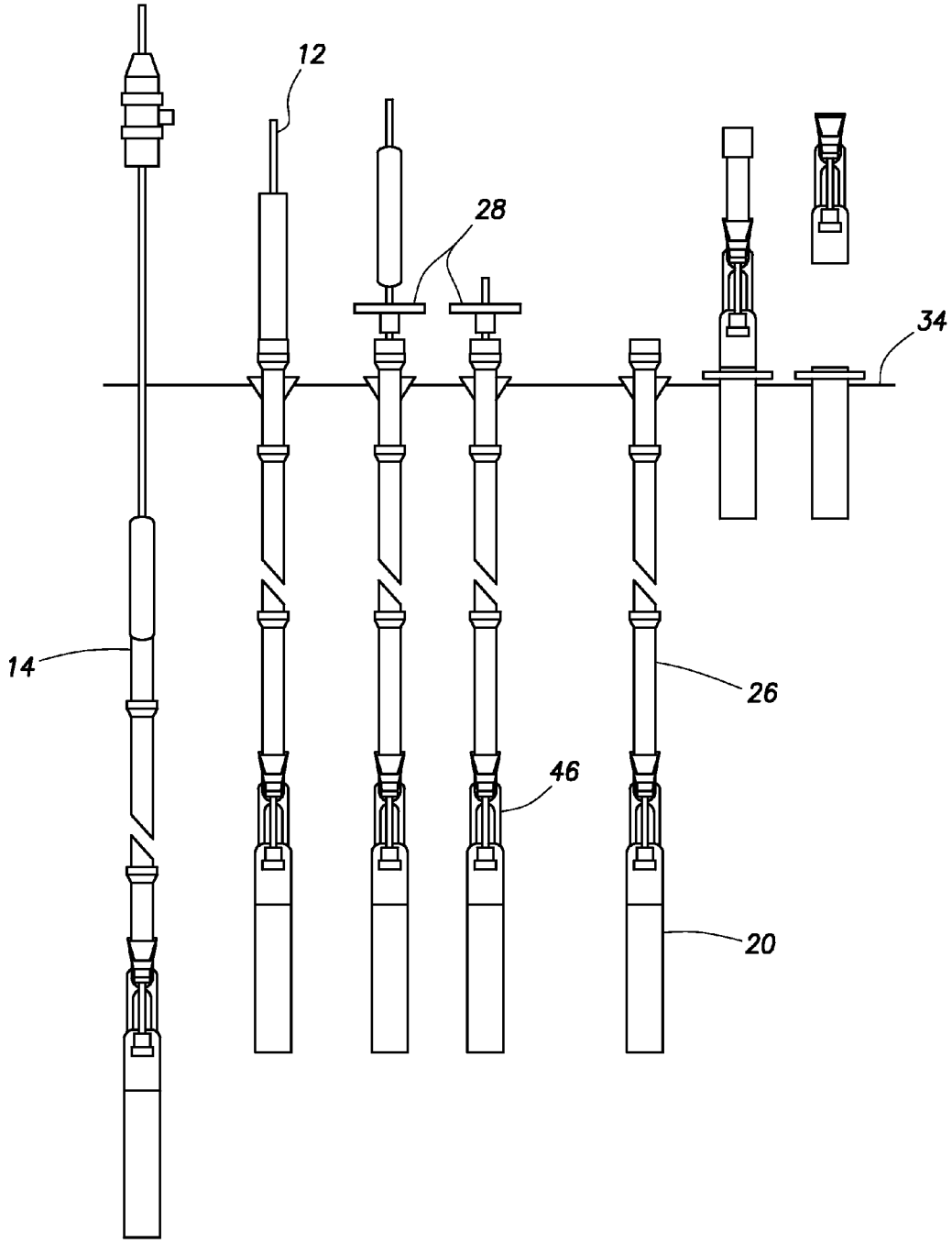
FIG. 7 shows a schematic side view of the apparatus in the sixth stage of progressive deployment of a wireline tool down a borehole, according to the invention.

Retrieval—Referring to FIG. 7:

Break riser below the rig floor and pick up (PU) before pull out of hole (POOH).

Ensure that the pipe is securely fastened to the floor.

52. Pull wireline to 200 ft and stop.
53. Raise pack-off above rig floor 34 using air hoist.
54. Pull umbilical 14 back to surface and set in slips or collar clamp.
55. Unscrew and raise fishing bell.
56. Lift wireline and install T-bar 28.
57. Remove umbilical junction head.
58. Strip in joint of rig drill pipe.
59. Connect two cables with SWSC
60. Make up (MU) drill pipe (DP) joint to top of umbilical pipe 26.
61. Run in hole (RIH) and set pipe joint in pipe rams.
62. Latch T-bar 28 with elevators and pull to break spider type weakpoint.
63. Pull cable out of hole and rig down wireline. Cable will have no weight. Keep upper sheave low to rig floor and use rubber line wiper to keep cable from whipping near end.
64. Drop ball into top of pipe and rig up (RU) to pump into pipe. Pump in slowly until disk ruptures (approximately 900 psi surface pressure).
65. Pull umbilical pipe 26 and set the BHA 20 in c-plate when at rig floor.
66. Lay down the last joint and rig the BHA 20 down.

While the present invention has been described with respect to a limited number of embodiments, those skilled in the art having the benefit of this disclosure, will appreciate numerous modifications and variations therefrom. It is intended that the appended claims cover all such modifications and variations as fall within the true spirit and scope of this present invention.

What is claimed is:

1. Apparatus for deploying a wireline tool and an umbilical conduit in a borehole, the apparatus comprising:

a wireline cable connected at a first end at the surface and releasably connected at a second end to a first end of an umbilical cable via a first connection means; and a second end of the umbilical cable releasably connected to a logging head of a wireline tool via a latching means, the logging head providing for mechanical and electrical connection between the wireline tool and the wireline cable via the umbilical cable;

wherein the umbilical cable is surrounded by umbilical pipe, and the logging head is adapted to provide a mechanical and hydraulic connection between the umbilical pipe and the wireline tool; and wherein the wireline tool is releasable from connection with the umbilical cable by a release means in the latching means, and adapted to be pulled through the latching means and through the umbilical pipe to be retrievable from the borehole.

2. Apparatus as claimed in claim 1, wherein the umbilical cable and the umbilical pipe form the umbilical conduit.

3. Apparatus as claimed in claim 2, wherein the umbilical conduit provides electric and hydraulic connectivity.

4. Apparatus as claimed in claim 1, wherein the first connection means includes a weakpoint.

5. Apparatus as claimed in claim 1, wherein the latching means includes a weakpoint.

6. Apparatus as claimed in claim 1, wherein the wireline cable includes a termination end.

7. Apparatus as claimed in claim 6, wherein the latching means includes a removable barrier means, that once installed, prevents the wireline cable termination end from passing through.

8. Apparatus as claimed in claim 7, wherein the barrier means is a no go.

9. A method of deploying a wireline tool and an umbilical conduit in a borehole, the method comprising the steps of:

connecting a first end of a wireline cable to a first end of an umbilical cable via a releasable connection means;

connecting a second end of the umbilical cable to a logging head of a wireline tool;

deploying the wireline cable, connected umbilical cable and connected logging head down the borehole;

detaching the wireline cable from the connection with the umbilical cable and replacing the connection with a first latching means and suspending the umbilical cable from an umbilical pipe via a second latching means at a downhole end of the umbilical pipe;

re-attaching the wireline cable to the first latching means of the umbilical cable, while the umbilical cable is suspended from the umbilical pipe in the well;

pulling the umbilical cable through the second latching means, through the umbilical pipe, and up to the surface by the wireline cable and thereby pulling the logging head into contact with the second latching means; and attaching the logging head to the second latching means;

wherein the logging head provides for mechanical and hydraulic connection between the umbilical pipe and the wireline tool, and wherein an electrical connection is provided between the wireline cable and the logging tool via the umbilical cable.

10. A method as claimed in claim 9, wherein the umbilical cable and the umbilical pipe form the umbilical conduit.

11. A method as claimed in claim 10, wherein the umbilical conduit provides electric and hydraulic connectivity.

12. A method of deploying a wireline tool in a borehole, the method comprising:

connecting a first end of a wireline cable to a first end of an umbilical cable via a releasable connection means;

connecting a second end of the umbilical cable to a logging head of a wireline tool;

deploying the wireline cable, connected umbilical cable and connected logging head down the borehole;

releasing the wireline cable from connection with the umbilical cable;

attaching a first latching means to the umbilical cable;

attaching umbilical pipe with a second latching means to the first latching means; and deploying the umbilical pipe with the second latching means downhole;

installing wireline cable through the umbilical pipe and connecting the installed wireline cable to the umbilical cable attached to the first latching means;

pulling the umbilical cable through the first and second latching means, through the umbilical pipe, and up towards the surface of the borehole;

attaching the umbilical cable to a connector and attaching the umbilical cable connector to an umbilical pipe termination;

attaching the umbilical pipe termination to the umbilical pipe; and attaching a wireline cable to a connector and attaching the wireline cable connector to the umbilical cable connector via the umbilical pipe termination.

13. The method as claimed in claim 12, wherein the umbilical cable and the umbilical pipe form the umbilical conduit.

14. The method as claimed in claim 13, wherein the umbilical conduit provides electric and hydraulic connectivity.

15. The method as claimed in claim 12, further comprising installing a barrier means in the first latching means, such that the wireline cable is prevented from passing through the first latching means.

16. The method as claimed in claim 15, wherein the barrier means is a no go.

17. The method as claimed in claim 12, wherein the connection between the wireline cable and the umbilical cable is mechanical.

18. The method as claimed in claim 12, wherein the connection between the wireline cable and the umbilical cable is electrical and mechanical.

* * * * *